US008804995B2

(12) United States Patent
North

(10) Patent No.: US 8,804,995 B2
(45) Date of Patent: Aug. 12, 2014

(54) LOW PROFILE LOUDSPEAKER

(75) Inventor: Donald J. North, Los Angeles, CA (US)

(73) Assignee: GGEC America, Inc., Santa Ana, CA (US)

( * ) Notice: Subject to any disclaimer, the term of this patent is extended or adjusted under 35 U.S.C. 154(b) by 137 days.

(21) Appl. No.: 13/283,529

(22) Filed: Oct. 27, 2011

(65) Prior Publication Data

US 2013/0108085 A1 May 2, 2013

(51) Int. Cl.
*H04R 1/00* (2006.01)
*H04R 9/06* (2006.01)

(52) U.S. Cl.
USPC ..... 381/431; 381/401; 381/423

(58) Field of Classification Search
CPC ..... H04R 1/00
USPC ..... 181/44, 45, 48, 157, 165; 381/396, 401, 381/423, 431
See application file for complete search history.

(56) References Cited

U.S. PATENT DOCUMENTS 4,357,498 A * 11/1982 Tsuchiya et al. ..... 381/401
5,701,359 A * 12/1997 Guenther et al. ..... 381/423

FOREIGN PATENT DOCUMENTS

JP 55046653 A * 4/1980 ..... H04R 1/24

* cited by examiner

*Primary Examiner* — Brian Ensey
(74) *Attorney, Agent, or Firm* — Fox Rothschild LLP

(57) ABSTRACT

In one embodiment, a co-axial speaker system for generating quality hi-fidelity sound with reduced distortion of wave propagation using a generally flat diaphragm and generally flat suspension.

4 Claims, 2 Drawing Sheets

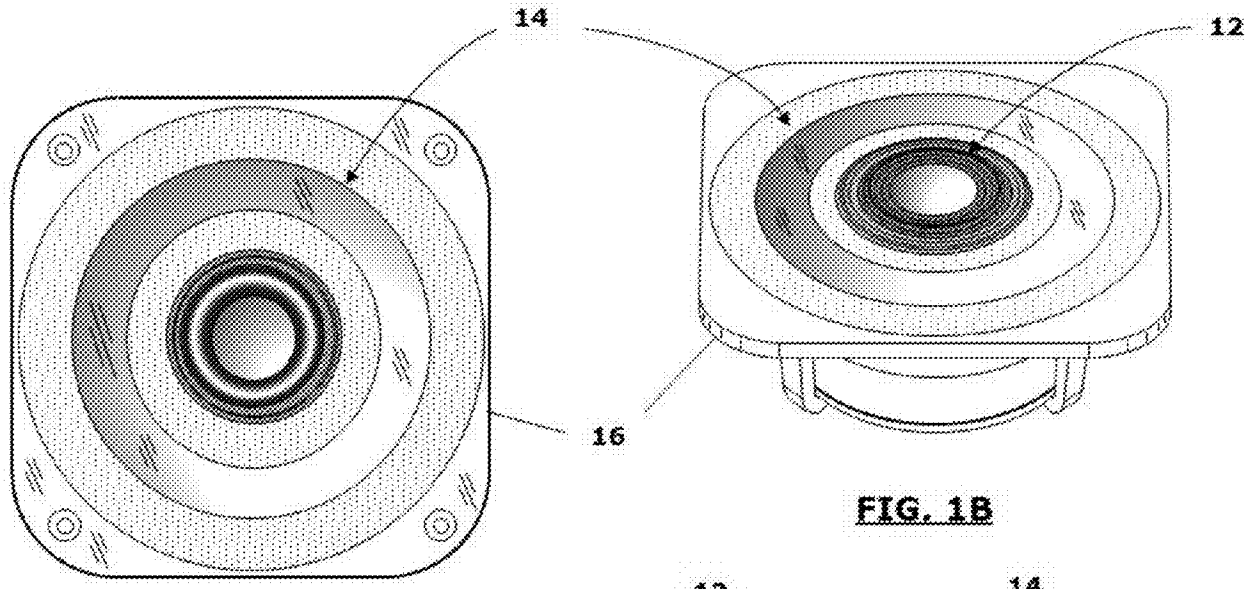
FIG. 1B
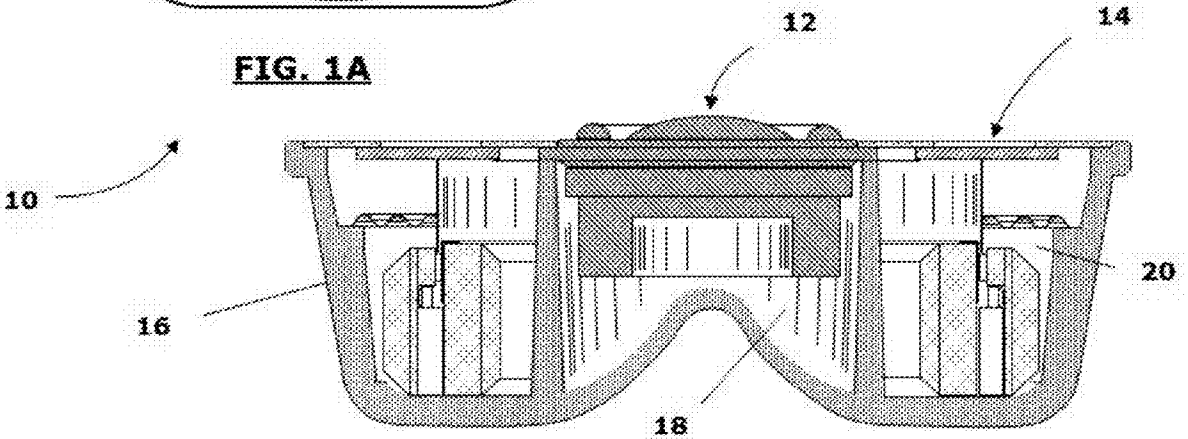
FIG. 1A
FIG. 1C

LOW PROFILE LOUDSPEAKER

BACKGROUND

The embodiments herein relate generally to a loudspeaker system and more specifically to a co-axial speaker system for generating enhanced sound by reducing the distortion of wave propagation using a generally flat diaphragm and generally flat suspension. The invention described may be applied to speakers that are not co-axial in nature, however.

The creation of robust hi-fidelity audio not only involves the science of carefully integrating an array of technologies for electronic to acoustic transformation, but also the art of passionately fine-tuning those integrated technologies within an optimized form factor to enrich the acoustic sound into an experience that is astounding to discerning audiophiles and inspiring to all. As such, modern loudspeakers have evolved over the years into truly enviable works of art and science. The invention described herein reflects the passion of combining art and science in a way that enhances the experience even more than what has been produced heretofore.

To appreciate the nuanced improvements described and claimed herein, it is first helpful to set the stage for those improvements by returning to the basics. In that regard, a loudspeaker is device that utilizes an electrical audio signal input to reciprocally drive controlled movement of ambient air to produce sound. The most common form of loudspeaker uses a paper cone supporting an electrical voice coil acting on a permanent magnet. In order to generate the wide range of frequencies necessary to reflect realistic sound, many speaker systems use multiple drivers each covering part of the range of frequencies desired from high to low levels. Ordinary listeners will recognize the driver names of subwoofers for very low frequencies, woofers for low frequencies, mid-range for middle frequencies, tweeters for high frequencies, and where desired, supertweeters for even higher frequencies.

Although different types of speaker drivers exist, one common type of driver employs a magnet surrounding an electrical voice coil to transform electrical input into a mechanical reciprocating motion of the voice coil that drives a diaphragm via a stiffly supported but lightweight carrier. As the voice coil carrier is driven in its reciprocating motion swiftly and repeatedly, the interconnected diaphragm moves with it, creating undulating sound waves perceived by the listeners as audio. The diaphragm is commonly recognized as the "cone" in a traditional mid-range or woofer speaker, or the "dome" of a tweeter design. The focus of the invention described and claimed herein is less on the driver system and more on the arrangement of the diaphragm and associated supports, but driver systems are well understood by the persons of ordinary skill in the art of speaker design.

With regard to diaphragms, more detail is warranted here for context. As indicated, diaphragms are usually constructed with a cone- or dome-shaped profile using one of various types of materials. Traditional diaphragms were made of paper or plastic, with the choice of material and design reflecting a balance of factors. For one, the diaphragm must be able to withstand the forces associated with driving it quickly and repeatedly in a reciprocating motion against the ambient air pressure. So the material must be rigid, but of not too much mass to require a large amount of energy to drive the diaphragm. For another, the diaphragm must be configured and supported so as to be appropriately damped against sustained vibrations due to its resonance frequency once the signal discontinues. To accommodate the competing designs, some speaker diaphragms today consist of a composite material such as cellulose paper embedded with other fibrous or rigid materials, such as carbon fiber, Kevlar, glass, hemp or bamboo fibers. Others employ a honeycomb sandwich construction, or reflect a laminate of differing materials that combine strong, stiff and lightweight materials into the diaphragm.

In any case, the diaphragm is typically supported with primary and secondary support members that permit the desired reciprocating travel in response to signal input while dampening post-signal vibrations. The primary support member maintains the diaphragm in a centered and suspended position above the driver, while the secondary support centers and aligns the voice coil carrier that is connected to the diaphragm and serves to restore the voice coil and the diaphragm to a neutral position after moving.

Sound wave generation and control is tricky because, as one can visualize by casting several objects into the water at one time, waves generated by a single source necessarily interfere with waves generated by other sources. Knowing that waves propagate radially outward from the source, the design of loudspeaker systems take into consideration how each speaker (i.e., individual source of acoustic waves), will interact with other near-by speakers in producing enjoyable audio. Minimizing the distortion of one set of waves by the propagation of an adjacent set of waves drives many high-performance speaker system designs. Of course, one solution is to space individually-driven speakers apart a sufficient distance. A recognized counterbalance to that spacing, however, is the competing desire to simulate a wide range of sound frequencies coming from a single source, which produces a more realistic audio output.

One theory espoused by some audiophiles is that a single source of audio covering the gamut of desired frequencies can generate more enjoyable sound. Based upon this theory, co-axial, and in some cases tri-axial, speakers have been developed to simulate single source sound. A co-axial speaker combines two concentrically-positioned drivers with, for example, a tweeter speaker in the middle surrounded by a mid-range or woofer speaker, both within a single frame or housing. Not surprisingly, co-axial speakers must be designed in a way to address the resultant wave distortion from having overlapping acoustic sources co-axially aligned.

At least one attempt to configure a co-axial speaker in a manner to reduce wave distortion between the central and outer driven diaphragms is embodied by the Thiel CS3.7 speaker system out in the market. With this system, the CS3.7 presents a lower-profile surface to the listener than what a traditional cone-shaped diaphragm presents. However, in doing so, the CS3.7 does not adequately provide a balance between reduced profile and clarity of sound because it employs a mid-range diaphragm that is configured with an radially-projecting corrugated profile that undermines to some degree what otherwise might afford significant reduction in wave distortion. The purpose of the corrugation is ostensibly to maintain sufficient stiffness while having a relatively low mass to withstand the forces of being driven in a reciprocating manner under dampening constraints. But the very solution the CS3.7 attempts to provide is essentially why it fails to achieve the desired balance. That is because the corrugations present obstacles to the acoustic wave output of the centrally-positioned tweeter diaphragm, reducing the benefits otherwise presented with a lower-profile wave guide.

SUMMARY

In embodiments of the present invention, a low-profile speaker system is provided that solves the problem of balancing weight and stiffness while meaningfully improving upon reduced wave distortion resulting in enhanced clarity of sound. In one embodiment, a coaxial speaker system is provided that comprises first and second speakers that function to generate sound virtually independent of each other while being positioned collectively within a single housing, with the coaxial speaker system comprising first and second speaker driver assemblies, each configured to drive the generation of sound waves within a range of frequencies. The speaker system also comprises first and second diaphragms, each respectively associated with the first and second speaker driver assemblies, where at least one of the diaphragms comprises an annular disc having a generally planar configuration thereby presenting a low profile configuration, with the diaphragm disc comprising a first surface directed away from its corresponding speaker driver assembly, and a second surface directed toward said corresponding speaker driver assembly. The generally planar disc may comprise one of a number of materials that provide the desired stiffness and weight, or it may comprise a composite of materials. In one embodiment, the generally planar disc diaphragm comprises a laminate of aluminum at one outer surface, a layer of foam core, a layer of woven fiberglass as the second outer surface.

Certain embodiments may further comprise a generally flat suspension assembly for supporting the annular disc in a manner that preserves the structural integrity of the disc when driven by the corresponding speaker driver assembly to reciprocating travel during operation and dampens undesired post-signal vibrations of the diaphragm disc. Preferably, the first surface of the annular disc comprises a generally flat surface, thereby eliminating essentially any physical obstruction to the propagation of sound waves directed over the annular disc. Where desired, the annual disc comprises a laminate of differing materials selected to balance weight and stiffness so that during operation the annual disc may undergo significant stresses in being driven to reciprocating travel by the corresponding speaker driver assembly so as to generating sound waves producing high quality sound within the desired frequency range while maintaining structural integrity. Numerous embodiments are contemplated by the present invention, with some described in more detail below.

BRIEF DESCRIPTION OF THE FIGURES

The detailed description of some embodiments of the invention will be is made below with reference to the accompanying figures, wherein like numerals represent corresponding parts of the figures.

FIG. 1 is a collection of three schematic views of one embodiment of the present invention, where FIG. 1A reflects a top view, FIG. 1B a perspective view, and FIG. 1C a cross-sectional view.

DETAILED DESCRIPTION OF CERTAIN EMBODIMENTS

Figure 2:
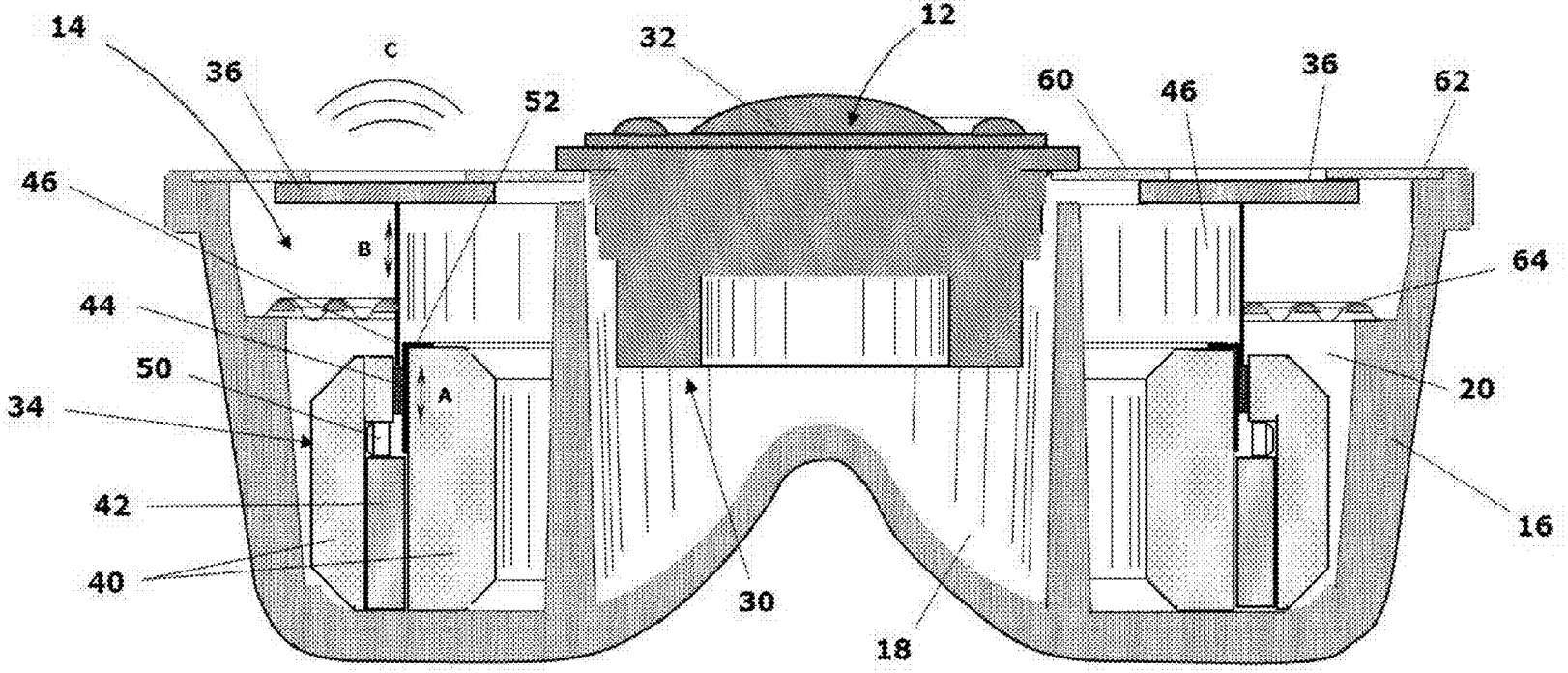
FIG. 2 is a close-up schematic cross-section of the embodiment of FIG. 1 showing the details of the speaker system.

By way of example, and referring to FIG. 1, one embodiment of the present invention is a speaker system 10, which in this example is a co-axial speaker system. Each speaker within the co-axial speaker system may cover one of a variety of ranges desired. For example, one may be a tweeter speaker providing higher frequency acoustic sound, while the other may be a mid-range speaker providing middle range frequencies of sound. The invention is not limited to either, and indeed the invention as described below may be applied to a single speaker housed by itself as well as one in coaxial alignment (or other juxtaposition) with a second speaker.

In the embodiment shown in the multiple views of FIG. 1, the speaker system 10 comprises a co-axial speaker system comprising a first speaker 12 centrally positioned within a second speaker 14, both secured within a housing 16. In this exemplary embodiment, the first speaker 12 is a tweeter speaker that may be configured in one of numerous possible fashions, but in this case is illustrated with a traditional dome diaphragm surrounded peripherally by a diaphragm support. The details of the first speaker 12 are not presented here, but may be appreciated by one of ordinary skill in the art. The second speaker 14 in this embodiment is a mid-range speaker, the details of which are described below.

With particular reference to FIG. 1C, the speaker system housing 16 comprises a first internal compartment 18 for housing the first speaker 12 and further comprises a second internal compartment 20 for housing the second speaker 14. In that regard, the housing need not conform to any particular configuration or arrangement for applicability of the present invention, but one or ordinary skill in the art will appreciate that the housing should be sufficient compact and sturdy to support high-performance speakers in a way that minimizes any adverse impact on the quality of acoustic sound generated by the speakers. The housing may be fully enclosed or partially enclosed, depending upon the needs for the system, but in this embodiment reflects a partially enclosed housing as reflected by the perspective view of FIG. 1B.

Referring to FIG. 2, one embodiment of the present invention may be described in more detail. In that regard, the first speaker 12 comprises a first driver assembly 30 housed within first internal compartment 18, where the first driver assembly 30 drives a corresponding first diaphragm 32. Although the first diaphragm is dome shaped, as is often found with tweeter speakers producing sound in the higher frequencies, other diaphragm shapes and configurations are contemplated. For example, whether generating sound in the tweeter range or lower mid-range, or even woofer range, the diaphragm may comprise a more generally planar profile, with a generally planar surround if so desired. The particulars of the first speaker may comprise aspects of the invention as described with reference to the second speaker below, or it may comprise more traditional features, depending upon the range and level of sound desired by the speaker system as a whole. Regardless, it is desired that, by incorporating the inventive features in at least one speaker of a multi-speaker system, such as a co-axial or tri-axial speaker system, there is a synergy reflected in the harmonious arrangement of speaker assembly components.

Continuing on, the second speaker 14 comprises a second driver assembly 34 housed within second internal compartment 20 that drives a second diaphragm 36. In the embodiment illustrated in FIG. 2, by example, the second diaphragm 36 comprises an annular configuration designed to encircle the first speaker 12, as also shown in FIGS. 1A-1C. Although this particular embodiment illustrated shows an entirely flat annular diaphragm, i.e., with a substantially uniform thickness throughout, it is contemplated that other low-profile configurations may be used to attain some of the benefits of the present invention. For example, the lower internal face of the second diaphragm may be contoured, reflective of a varied thickness, where the top exposed surface remains substantially flat while the bottom surface may comprise one or more annular or radial protuberances. Such embodiments may be chosen based upon optimizing reduced weight with adequate stiffness, without impacting materially the sound perceived by the listener associated with a diaphragm having a generally flat exposed surface.

By way of example, the second driver assembly 34 comprises a yoke 40 for securing therewith a permanent magnet 42, both in annular arrangements within compartment 20. The yoke 40 further secures therewith—in a detached but suspended fashion—an electric voice coil 44 connected to a generally cylindrical bobbin 46 extending from the voice coil 44 to the second diaphragm 36, and secured thereto. Preferably, a shorting ring 50 and copper sleeve 52 are provided to reduce modulation of the permanent magnet's flux and voice coil inductance respectively and improving sound quality. It should be noted that those of ordinary skill in the art will recognize the term voice coil as referring to both the annular electric voice coil 44 and the bobbin 46 components, and is sometimes used interchangeably with the specific electronic component 44 itself. This application uses the term to apply to the electric component 44 itself, which in combination with the bobbin 46, moves the second diaphragm 36 as explained below.

In operation, when a signal is applied to the voice coil 44, it induces an electric current that interacts with the magnetic field created within the yoke 40 by the permanent magnet 42 to create a force and drive the voice coil 44 in a reciprocating motion, which in the illustration of FIG. 2, would occur in a vertical direction, as shown by arrow A. As the voice coil 44 is secured to the cylindrical bobbin 46, the reciprocating motion of the voice coil 44 drive an equally reciprocating motion of the bobbin 46 as reflected by arrow B. This in turn drives the diaphragm 36 in a reciprocating fashion to generate sound waves reflected by waves C. In other words, the electrical input to the speaker system is converted into mechanical energy to create sound waves that are audibly discernable. It is contemplated that other types of speaker drivers that are known or that may be developed could work within and in association with the inventive embodiments described herein. For example, axial or radial permanent magnets may be used.

In certain embodiments, the second annular diaphragm 36 is supported preferably with an adhesive or other acceptable means by a surround comprising a first annular collar 60 and second annular collar 62, both supported directly or indirectly by the speaker housing 16. The first speaker assembly 12 may be positioned adjacent the first annular collar 60 or spaced therefrom, and the height of the first speaker 12 may be set higher or lower with respect to the second speaker assembly 14 as so desired or to enhance sound output.

The second annular diaphragm 36 is also supported preferably by a component known in the industry from its historical name of spider 64, although it may or may not resemble a spider in its present configuration. The spider 64 in the example illustrated comprises an undulating series of annularly arranged corrugations that is attached securely along one side to the speaker housing 16 and along the other side to the bobbin 46. The spider 64 is preferably made of material that maintains a desired stiffness to dampen undesired vibrations of the second diaphragm 36 but resilient enough to move within the intended excursion of the few millimeters of so that the voice coil 44 reciprocates during operation. The configuration of the spider 64 need not be configured as an undulating annular corrugation, but may be generally flat, depending upon the size and materials selected for the spider, reflecting the innovation presented by the invention herein.

In that regard, the annular diaphragm 36 has at least two main surfaces, one externally-directed toward the ambient generating the desired sound waves, and a second surface to which the bobbin 46 is secured. While the annular diaphragm 36 is preferably generally flat, that configuration may apply to the externally-directed surface but need not apply to the internally-directed surface connected to the bobbin 46. Likewise, the preferably generally flat surround of the second speaker 14 has two surfaces, and it is more desirably to have the externally-directed surface of the collars 60, 62 reflect a generally flat profile, while the internally-directed surfaces of the surround need not be so configured. One of the benefits of certain embodiments of the present invention is that a generally flat profile is presented entirely around the first speaker 12 reducing the interference presented by the second speaker 14 to the radiating sound generated by the first speaker 12. Indeed, it may be desired to design the first speaker 12 to present a lower profile than reflected in the example embodiment of FIGS. 1 and 2, where the diaphragm 32 and/or its surround are generally flat as well. Indeed, the first speaker diaphragm 32 may reflect a concave profile to varying degrees. So the phrase generally flat can apply to the component as a whole or to at least one surface of the component. The phrase also includes a surface that is concave or minimally convex.

The generally planar disc may comprise one of a number of materials that provide the desired stiffness and weight, or it may comprise a composite of materials. In one embodiment, the generally planar disc diaphragm comprises a laminate of aluminum at one outer surface, and where the second outer surface may comprise either aluminum, or another light weight metal, or still other light weight non-metal such as Kevlar® or carbon fiber. It is desired that these two surfaces of lightweight material sandwich, for example, a layer of foam core and woven fiberglass therebetween. Alternatively, a honeycomb arrangement of material may be used in place of the foam core and/or woven fiberglass, with such honeycomb arrangement comprising, by way of example only, Nomex® material.

It should be noted that the schematic views presented in FIGS. 1A-1C and 2 are not intended to accurately reflect relative sizes of all of the components, as some have been enlarged to present a more visible arrangement of components. For example, it is contemplated that the second diaphragm 36 would be much thinner in its thickness relative to the second driver assembly 34. It should also be noted that the present invention, including a truly low-profile diaphragm and optionally including low-profile surrounds, may be embodied in a single speaker system rather than a co-axial or tri-axial design.

In the world of audiophiles, as noted above, speaker designs present an important combination of science and art. Although there are not necessarily many parts within a speaker assembly, every part matters. By that it is meant that the parts are designed and joined in a way that is mutually synergistic to produce repeatable, reliable, high-fidelity sound across a range of wavelengths. The invention herein, as reflected by exemplary embodiments presented, capitalizes not just on optimizing those few parts, but ensuring the synergy demanded by consumers of fine audio output by including an inventive configuration of components.

What is claimed is:

1. A coaxial speaker system for generating quality hi-fidelity sound with reduced distortion of wave propagation, the coaxial speaker system comprising first and second speakers that function to generate sound virtually independent of each other while being positioned collectively within a single housing, the coaxial speaker system comprising:

first and second speaker driver assemblies, each configured to drive the generation of sound waves within a range of frequencies, first and second diaphragms, each respectively associated with the first and second speaker driver assemblies, where at least one of the diaphragms comprises an annular disc having a generally planar configuration thereby presenting a low profile configuration, the diaphragm disc comprising a first surface directed away from its corresponding speaker driver assembly, and a second surface directed toward said corresponding speaker driver assembly, and a suspension assembly for supporting the annular disc in a manner that preserves the structural integrity of the disc when driven by the corresponding speaker driver assembly to reciprocating travel during operation and dampens undesired post-signal vibrations of the diaphragm disc, the suspension assembly including a first and second annular collars each supported relative to the housing with the first annular collar supporting a radially inner edge of the annular disc and the second collar supporting a radially outer edge of the annular disc, each collar defining a continuous outer planar surface.

2. The coaxial speaker system of claim 1, wherein the first surface of the annular disc comprises a generally flat surface, thereby eliminating essentially any physical obstruction to the propagation of sound waves directed over the annular disc.

3. The coaxial speaker system of claim 1, wherein the annular disc comprises a laminate of differing materials selected to balance weight and stiffness so that during operation the annular disc may undergo significant stresses in being driven to reciprocating travel by the corresponding speaker driver assembly so as to generating sound waves producing high quality sound within the desired frequency range while maintaining structural integrity.

4. The coaxial speaker system of claim 1, wherein at least one speaker driver assembly comprises a magnet and a voice coil for converting electrical signals into mechanical energy reciprocating its corresponding diaphragm.

* * * * *